United States Patent [19]

Powell

[11] 4,296,905

[45] Oct. 27, 1981

[54] BUILDING SCAFFOLD SUPPORT

[76] Inventor: Charles R. Powell, 6729 N. Richmond Ave., Portland, Oreg. 97203

[21] Appl. No.: 928,237

[22] Filed: Jul. 26, 1978

Related U.S. Application Data

[63] Continuation-in-part of Ser. No. 836,027, Sep. 23, 1977, abandoned.

[51] Int. Cl.[3] ..... A47G 29/02

[52] U.S. Cl. ..... 248/237; 182/150

[58] Field of Search ..... 248/236, 237, 240, 241, 248/240.3, 240.4, 326, 291; 182/45, 142, 150, 82

[56] References Cited

U.S. PATENT DOCUMENTS

| | | | |
|---|---|---|---|
| 1,423,998 | 7/1922 | Camp | 182/45 X |
| 2,623,794 | 12/1952 | Osten | 248/237 X |
| 3,011,587 | 12/1951 | Mallog | 182/150 |
| 3,767,010 | 10/1973 | Newlan | 182/150 |
| 4,022,293 | 5/1977 | Hallagin | 182/150 |

FOREIGN PATENT DOCUMENTS

| | | | |
|---|---|---|---|
| 90234 | 1/1922 | Switzerland | 182/150 |
| 250300 | 6/1948 | Switzerland | 182/150 |

*Primary Examiner*—J. Franklin Foss

*Attorney, Agent, or Firm*—Eugene M. Eckelman

[57] ABSTRACT

One or more elongated base members are arranged to lie on the top surface of a building with their outer end portions projecting beyond the side of the building. These base members have a depending arm connected to the outer end portion thereof, and a scaffold for workmen is arranged to be suspended from such arms by suitable suspension lines or the like. The connection between the arms and their base members is adjustable on a horizontal axis so that the arms can be positioned at selected angles, including an acute angle, relative to the base member and arranged to extend under an overhang on the building if necessary. Workmen can thus be supported close to the side of the building even though the latter has an overhang.

3 Claims, 10 Drawing Figures

BUILDING SCAFFOLD SUPPORT

REFERENCE TO PRIOR APPLICATIONS

This application is a continuation-in-part of application Ser. No. 836,027, filed Sept. 23, 1977 now abandoned.

BACKGROUND OF THE INVENTION

This invention relates to new and useful improvements in building scaffold supports and particularly pertains to a support arranged to be used with buildings having an overhang.

Many of the larger type buildings and particularly the older ones have overhangs which make it difficult to lower supports for workmen for the purpose of washing windows or generally maintaining the walls of the building. Some prior scaffold supports use large C-shaped hooks one end of which seats on the roof and the other end of which supports cables or the like for supporting the scaffold. Other apparatuses have been employed such as shown in U.S. Pat. No. 3,767,010 which employs a top foot for seating on the roof and an angular support arm for supporting an end of the scaffold.

Such prior apparatuses have inherent disadvantages. One disadvantage of some of them is that they cannot suspend the scaffold close enough to the building so that the workmen can be within a working length of the side of the building. Another disadvantage of some of the prior apparatuses is that they do not employ the necessary versatility or adaptation to different types of buildings and their overhangs. A still further disadvantage of some of the prior apparatuses is that they are not completely safe in their support from the roof.

SUMMARY OF THE INVENTION

According to the present invention and forming a primary objective thereof, a scaffold support for buildings is provided which is arranged to suspend workmen close to the building even though the building has an overhang for convenience of the workmen in reaching the building and furthermore to provide such a support which is adjustable so as to be versatile in its use on different building structures. It is also an object of the invention to provide a support having a structure which provides maximum safety in use.

For the purpose of carrying out the above objectives, one or more base members are employed which are arranged to lie flat on the top of a building. The outer ends of the base members provide support for arms in depending relation. Adjustable means are provided for connecting the arms to the base members and positioning the arms selectively back toward the building so that said arms can extend below an overhang and position workmen supported on a scaffold close to the building. The base members and arms are adjustable in length to provide further versatility in use.

The invention will be better understood and additional objects and advantages will become apparent from the following description taken in connection wth the accompanying drawings which illustrate a preferred form of the device.

DETAILED DESCRIPTION OF A PREFERRED EMBODIMENT

Figures 1, 2, 3, 4, 5, 6:
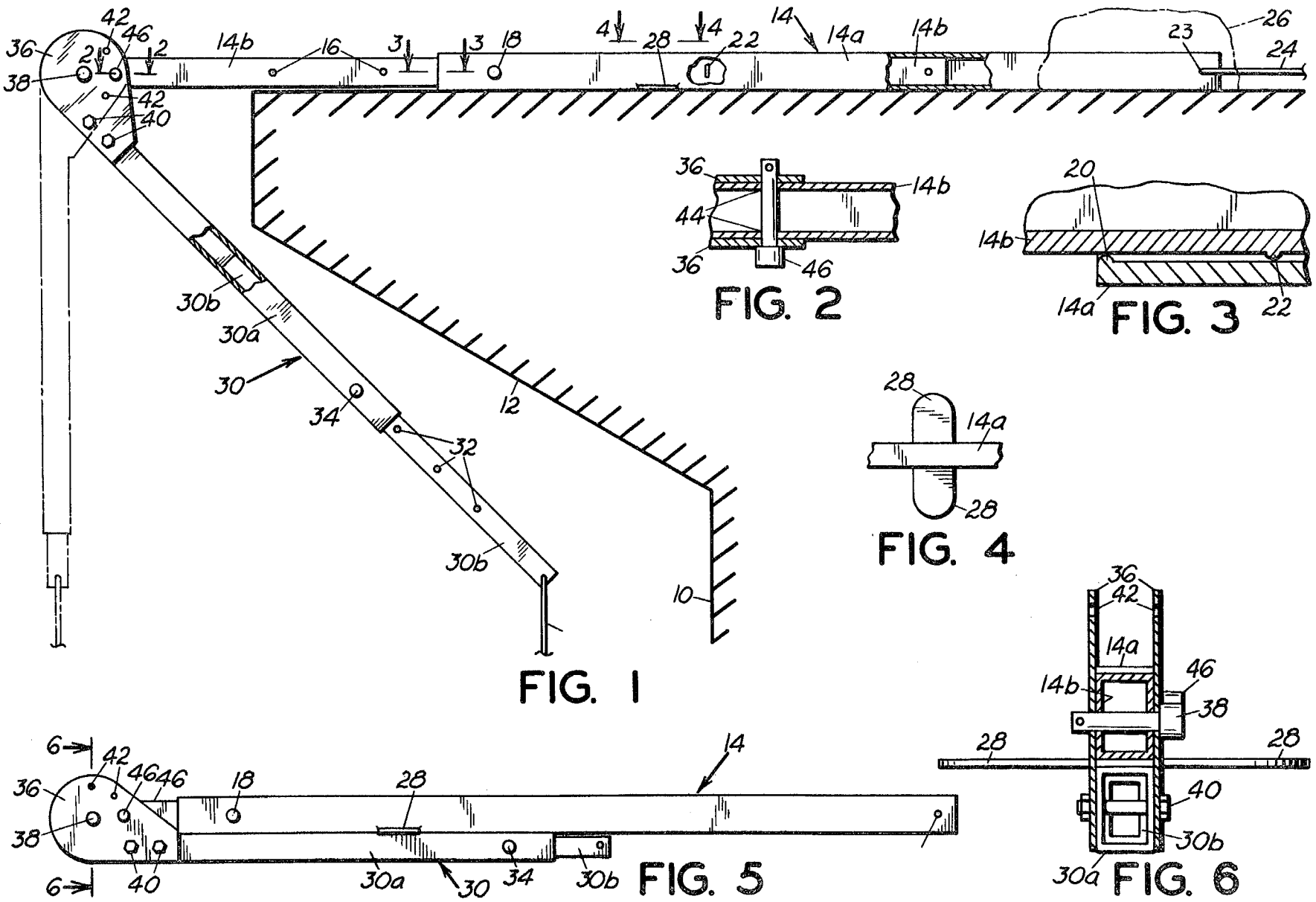
FIG. 1 is a side elevational view of a first form of building scaffold support embodying features of the present invention, a portion of a building being shown to illustrate use of the invention.
FIG. 2 is an enlarged fragmentary sectional view taken on the line 2—2 of FIG. 1.
FIG. 3 is an enlarged fragmentary sectional view taken on the line 3—3 of FIG. 1.
FIG. 4 is a fragmentary plan view taken on the line 4—4 of FIG. 1.
FIG. 5 is a side elevational view of the present apparatus in folded position.
FIG. 6 is an enlarged sectional view taken on the line 6—6 of FIG. 5.

With particular reference first to FIG. 1, the numeral 10 designates a building and the numeral 12 designates an overhang on the building, such an overhang making it difficult to support window washing equipment or the like from the top of the building in a position which provides convenient positioning of a scaffold for workmen.

According to a first form of the present invention and with reference to FIGS. 1–6, a base member 14 is provided having an elongated tubular main portion **14*a* and an elongated extension portion 14*b* which has telescoping mounting within the portion 14*a*. Extension portion 14*b* may also be tubular for strength purposes. Length adjustment of the base member 14 is accomplished by means of a plurality of holes 16 in one or the other of the two portions 14*a* and 14*b* and an anchor pin 18 extending through the other portion and removably engageable in the holes 16. To prevent separation of the two portions 14*a* and 14*b* and thus eliminate any possibility of accident, the outer end of base portion 14*a* has an inturned bead 20, FIG. 3, and the inner end of the base portion 14*b* has an outwardly turned bead 22. The dimensional arrangement is such that the bead 22 cannot pass beyond the bead 20** and thus the parts cannot be separated.

The inner end of the base member 14 has an aperture 23 or other connecting means for a tie line 24 for positively holding the base member on the building. For further anchoring the inner end of the base member, it may be held down by a suitable weight 26, such as one or more sandbags. To provide lateral stability for the base member 14, the portion **14*a* thereof has laterally extending foot or stabilizing members 28, FIGS. 1 and 4, the bottom surfaces of which are flush with the bottom surface of the base portion 14*a***.

Supported on the outer end of base portion **14*b* is a depending arm 30 comprising an elongated portion 30*a* which is tubular in form and which telescopically receives an elongated extension portion 30*b*. Length adjustment of the arm 30 is accomplished by means of a plurality of holes 32 on one or the other of the portions 30*a* and 30*b* engageable selectively by a removable pin 34**.

For connecting the upper end of arm 30 with the base portion 14*b*, portion 30*a* of the arm has a pair of integral enlarged side plates 36 extending on opposite sides of the base portion 14*b* and pivotally connected thereto by a pin 38. Side plates 36 are integrally secured to the arm portion 32*a* by bolts 40 or other suitable means such as by welding.

Arm 30 is arranged to be held in selected angular positions relative to the base member 14 by a latch mechanism comprising a plurality of holes 42 in the side plates 36 arranged for registering with a hole 44, FIG. 2, in base portion 14*b* and arranged with said hole 44 to receive a latch pin 46. By using a selected hole 42 for latching, the arm 30 can be positioned at the desired angle relative to the base member 14, such as at an acute angle as shown in full lines in FIG. 1 for use with buildings having an overhang, or straight down as shown in broken lines for use with buildings without overhangs. The plates 36 may have any number of holes 42 to provide a selected angular position for the arms 30.

With particular reference to FIG. 5, the device may be folded flat with the arm 30 up against the base for handling and storage, and to hold the apparatus in such folded position, one of the holes 42 may be positioned selectively so that the latch pin 46 holds the two parts together. The base member and arm in this folded position can be held in their shortened condition by their latch pins 18 and 34 engageable in selectively located holes 16 and 32, respectively.

In the use of the present scaffold support, two or more of them are laid flat on top of the building and secured to the building against outward movement by tie lines 24. If necessary, weights 26 may be placed on the rearward ends of the base members. Suitable angular adjustment of the arms 30 relative to their base members is accomplished by selected latch positioning of the arms. Also, suitable length adjustment of the base 14 and arm 30 is accomplished, these adjustments providing a versatility of the apparatus for adaptation to various buildings and overhangs for positioning the scaffold a convenient work distance from the building.

Figure 7:
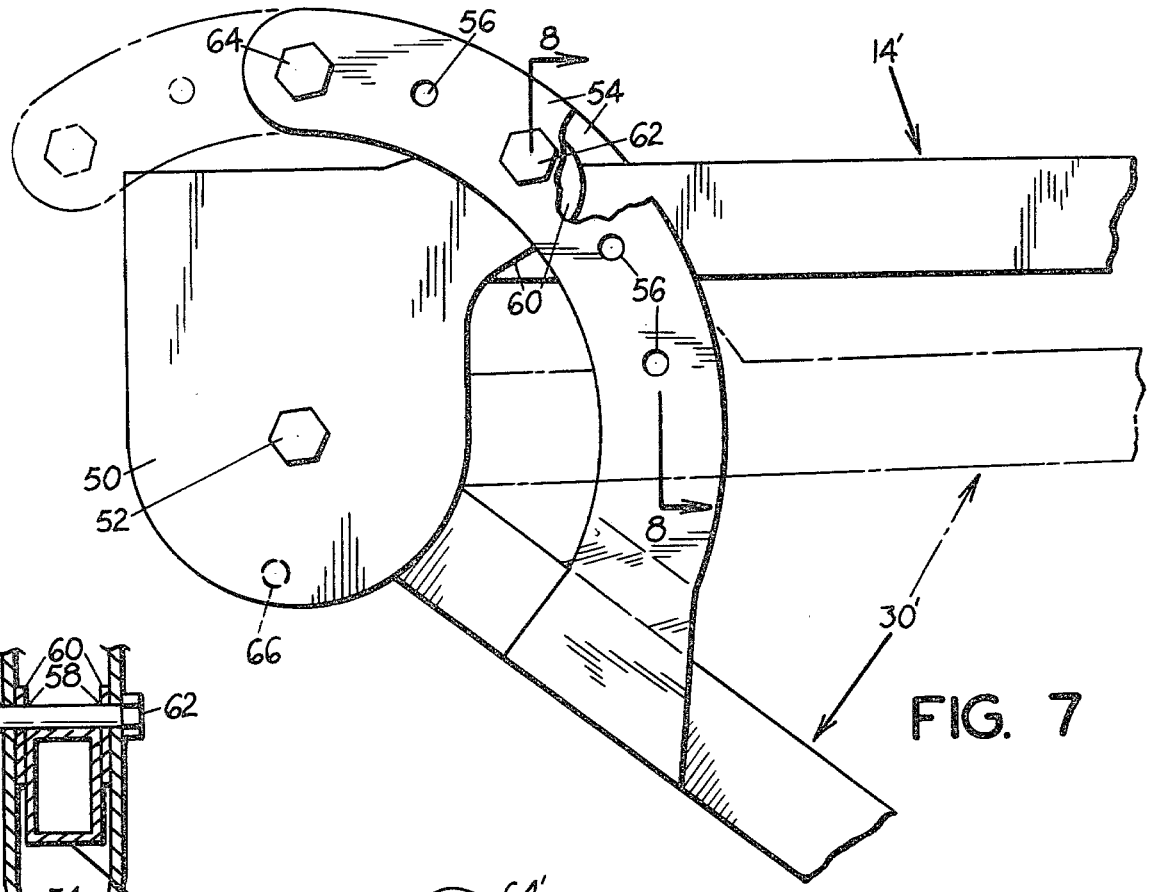
FIG. 7 is a fragmentary side elevational view of a further embodiment of a building scaffold support also embodying features of the present invention.
Figure 8:
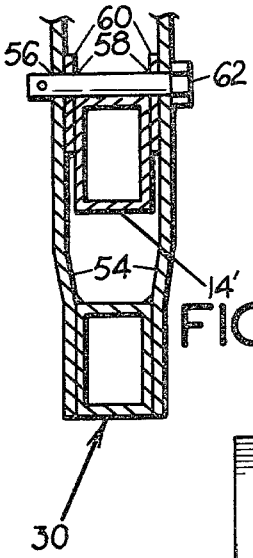
FIG. 8 is a fragmentary sectional view taken on the line 8—8 of FIG. 7.

With reference to FIGS. 7 and 8, a modified structural arrangement is provided for connection between a base portion 14' and a depending arm 30'. These two portions may be extendable in length the same as in FIG. 1 and similarly the inner end of base portion 14' may be associated with a tie line 24, not shown, and hold-down means 26, also not shown.

In the structure of FIGS. 7 and 8, the outer end of base portion 14' has an enlarged depending side plate 50 integral with each side thereof, and these side plates support a cross pin 52 forming a shaft for pivotal connection and partial support of the arm 30' on the base portion. Arm 30' has a pair of arcuate outwardly turned integral support extensions 54 leading upwardly one from each side thereof and spaced a short distance inwardly from the side plates 50. These extensions have a series of holes 56 therein provided in concentric relation with pin 52 and arranged for selected matching alignment with apertures 58 in rearwardly and obliquely extending projections 60 integral with side plates 50. Apertures 56 and 58 are associated with a pin 62 to hold the arm 30' in selected angular relation for providing the versatility of application to various buildings and particularly to buildings with overhangs. One of the apertures 56 is positioned to hold the arm 30' in a folded or collapsed position shown in broken lines in FIG. 7.

The connecting structure between the base portion 14' and arm 30' provides an extremely rugged and safe support for such arm. The weight of the arm 30' is primarily supported by pin 62 although the pin 52 also supports some weight. Safety means are employed to insure that the arm 30' will not swing out beyond a straight down depending position in the event that the pin 62 fails. For this purpose, a cross bolt 64 is secured between the extensions 54 adjacent the ends of the latter and such cross bolt is arranged to engage the top arm portion 14' or ears 60 in such failure instance. In addition, a cross pin 66 is secured between side plates 50 in a predetermined position for abutment by arm 30' and limit outward swinging movement thereof.

Figure 9:
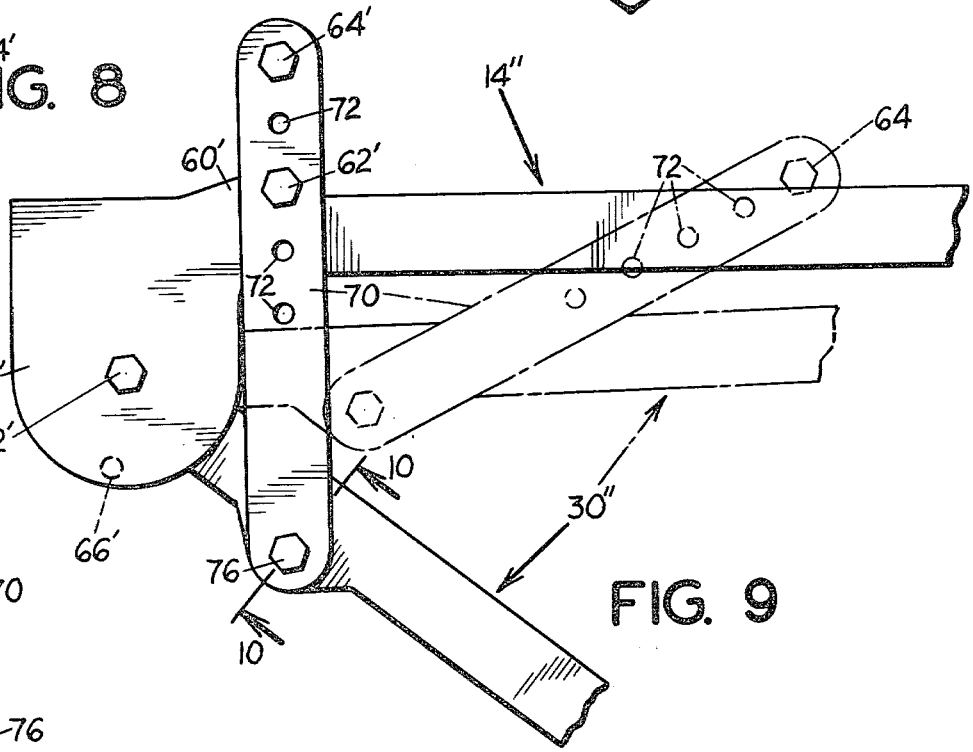
FIG. 9 is a fragmentary side elevational view of still a further embodiment of the invention.
Figure 10:
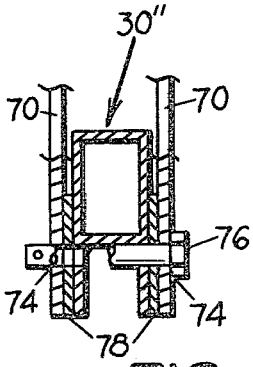
FIG. 10 is a fragmentary sectional view taken on the line 10—10 of FIG. 9.

FIGS. 9 and 10 show another form of support connection between a base portion 14'' and a depending arm 30''. Here again, these two portions may be extendable as in FIG. 1 and similarly associated with a tie line and hold-down means. In this embodiment, the outer end of base portion 14'' has an enlarged depending plate 50' integral with each side thereof and a cross pin 52', such structure being the same as in FIG. 7 with the side plates 50' similarly having rearward and obliquely extending ears 60' receiving a pin 62'.

The main weight of arm 30'' in this embodiment is supported by a pair of straight side links 70 having a series of adjusting holes 72 for selected engagement by pin 62' for angular positioning of arm 30'' and having apertures 74 at their lower ends for pivotally receiving a pin 76 also passing through arm 30''. Washers 78 are provided between links 70 and arm 30''.

The embodiment of FIGS. 9 and 10 also provides an extremely rugged and safe support for the depending arm in providing support at both the pin 62' and pin 52'. This structure also includes a safety cross bolt 64' secured between the upper ends of links 70 and arranged to engage against the top of the arm structure 14'' in the event of failure of pin 62'. A stop pin 66' is also provided between side plates 50' for abutment by arms 30' to limit outward swinging movement thereof.

The structure of FIG. 9 will fold to a collapsed condition by removing pin 62' and allowing the upper ends of the links 70 to pivot rearwardly, as seen in broken lines in FIG. 9, the bolt 64' sliding rearwardly on the top surface of arm 14''.

As stated hereinbefore, the present support can be used singly for supporting a sling or the like or as seen in FIG. 11, two of such supports may be used in spaced relation for holding an elongated scaffold or the like, not shown.

It is to be understood that the forms of my invention herein shown and described are to be taken as preferred examples of the same and that various changes in the shape, size and arrangement of parts may be resorted to without departing from the spirit of my invention, or the scope of the subjoined claims. Although the present apparatus is described as a support wherein two or more of the apparatuses are used to support a scaffold therebetween, it is to be understood that a single one of the supports may be used to support a single workman in a sling or the like.

Having thus described my invention, I claim:

1. A scaffold support for buildings comprising (a) an elongated base member having front and rear end portions and arranged to lie on a top surface of a building with said front end portion projecting beyond a side of the building, (b) means on said base member arranged to hold it down on a building, (c) rigid plate means depending integrally from the front end of said base member, (d) a rigid scaffold supporting arm having upper and lower ends, (e) means on the lower end of said arm for connecting a scaffold thereto, (f) pivot support means pivotally connecting the upper end of said arm to the lower end of said plate means, (g) rigid extension means having upper and lower ends, (h) the lower end of said extension means being secured integrally to said arm at a point downward from said pivot connection of said arm with said plate means, (i) said extension means extending upwardly along a rearward side portion of said plate means, (j) said rearward portion of said plate means having a pin receiving aperture above said base member and said extension means having a plurality of spaced pin receiving apertures, (k) and cross pin means arranged for removable mounting in the apertures in said plate means and in said extension means to provide selected angular disposition of said arm relative to said base member.

2. The scaffold support of claim 1 wherein said plate means includes a pair of plates secured to opposite sides of said base member and said arm is pivotally connected between said plates by said pivot support means, said extension means including a pair of links secured to opposite sides of said arm and passing on opposite sides of said plate means for receiving said pin means.

3. The scaffold support of claim 1 wherein said plate means includes a pair of plates secured to opposite sides of said base member and said arm is pivotally connected between said plates by said pivot support means, said extension means including a pair of links secured to opposite sides of said arm and passing on opposite sides of said plate means for receiving said pin means, and a permanently mounted cross pin secured to said extension means adjacent the upper end thereof arranged to engage said base member to limit rotative movement of said arm in one direction.

* * * * *